United States Patent [19]

Ishikawa

[11] 4,078,707

[45] Mar. 14, 1978

[54] DIPPING TYPE MOLTEN METAL FEEDING APPARATUS

[75] Inventor: Noritoki Ishikawa, Fuchu, Japan

[73] Assignee: Ryobi, Ltd., Fuchu, Japan

[21] Appl. No.: 672,924

[22] Filed: Apr. 2, 1976

[30] Foreign Application Priority Data

| | | |
|---|---|---|
| Apr. 3, 1975 | Japan | 50-41035 |
| May 12, 1975 | Japan | 50-56309 |

[51] Int. Cl.[2] ..... B22D 39/00

[52] U.S. Cl. ..... 222/629; 164/336; 222/357

[58] Field of Search ..... 222/356, 357, 358, 604, 222/629; 164/336

[56] References Cited

U.S. PATENT DOCUMENTS

| | | | |
|---|---|---|---|
| 2,463,811 | 3/1949 | Schulze | 222/604 |
| 3,774,815 | 11/1973 | McCarthy | 164/336 X |
| 3,923,201 | 12/1975 | Hersh et al. | 222/357 X |

FOREIGN PATENT DOCUMENTS

| | | | |
|---|---|---|---|
| 28,807 | 10/1965 | Japan | 164/336 |
| 1,313,911 | 4/1973 | United Kingdom | 222/604 |

*Primary Examiner*—Robert B. Reeves
*Assistant Examiner*—David A. Scherbel
*Attorney, Agent, or Firm*—Sughrue, Rothwell, Mion, Zinn and Macpeak

[57] ABSTRACT

A ladle of an automatic molten metal feeding apparatus of a die-casting machine is supported by a pair of links which are driven in synchronism with a constant velocity relation whereby a lateral shift range of the pouring end of the ladle is regulated.

5 Claims, 12 Drawing Figures

DIPPING TYPE MOLTEN METAL FEEDING APPARATUS

BACKGROUND OF THE INVENTION

This invention relates to apparatus for automatically feeding molten metal, and particularly to an apparatus for automatically feeding molten metal from a heating furnace to a casting machine.

More particularly, the present invention relates to an automatic apparatus for feeding molten metal to a die casting machine, which apparatus automatically feeds a charge of molten metal, such as a high temperature point alloy made molten in a high temperature heating furnace, to a shot chamber, and which apparatus is simple in structure, readily operable and highly economical. For example, British Pat. No. 1,313,911 shows an automatic molten metal feeding apparatus comprising a first shaft arranged to be displaceable along its longitudinal axis and rotatable about said axis, a second shaft coupled to said first shaft transversely thereof and rotatable about its longitudinal axis, means for displacing said first shaft, a guide member provided with a guide channel which co-operates with said second shaft, a ladle connected to an arm member, and means for supporting said arm member on said second shaft, wherein on displacement of said first shaft said ladle is displaced along a path determined by the contour of the guide channel.

The displacing means may comprise the piston and the piston rod of a pressure fluid cylinder connectable with a pressure fluid source, one end of the first shaft being coupled to the piston rod by means permitting said first shaft to rotate about its longitudinal axis. The hydraulic cylinder may be connected to an independent pressure source with a pressure medium such as air, water or oil, or it may communicate, for example with the pressure circuit of a diecasting machine to which the apparatus of the present invention is applied.

Preferably, the guide member comprises a hollow cylindrical member surrounding said first shaft and said guide channel is provided in a circumferential wall of the hollow cylindrical member.

Conveniently, a ladle is attached to the rotatable means through the arm, so that it may be moved as the rotatable means is first moved vertically then is rotated horizontally through a predetermined angle, whereby it takes up a charge of molten metal from a molten bath and is then moved to a pouring position relative to a casting machine to pour the charge into the casting machine through its ingate, then is returned to the bath.

The guide channel comprises an upper vertical portion, a lower vertical portion and an intermediate sloped helical portion connecting said upper and lower vertical portions. Advantageously, the co-operation between said supporting means and said second shaft as said roller ascends the upper vertical portion of said guide channel is such as to cause said ladle to be tilted to discharge its contents.

The operation of the molten metal feeding apparatus of British Pat. No. 1,313,911 may be electrically controlled by combining an electric circuit with the apparatus.

SUMMARY OF THE INVENTION

The present invention intends to provide an improved molten metal feeding apparatus which is simple in construction and economical and by which the shift of the pouring end of the ladle is substantially eliminated.

Another object of the present invention is to provide a regulator for controlling the amount of molten material to be carried by the ladle.

Other objects and features of the present invention will become apparent from the following description of preferred embodiments of the present invention with reference to the drawings.

DESCRIPTION OF THE EMBODIMENT

Figure 1:
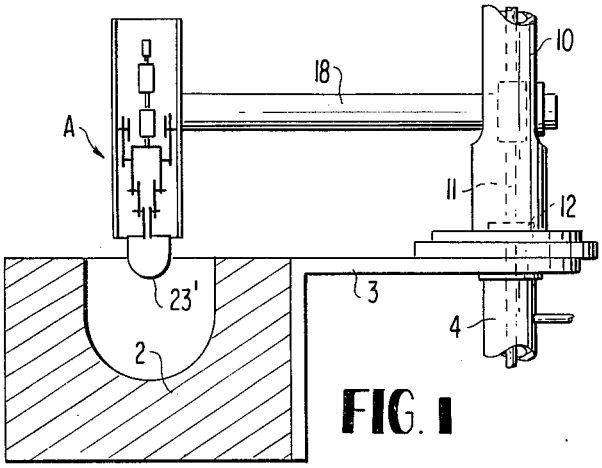
FIG. 1 is a front view of the apparatus equipped with a ladle handling apparatus according to the present invention.

Referring to FIG. 1, the horizontal shaft 18 of the prior art molten metal feeding apparatus is extended laterally and a ladle operating means A is suitably provided on the top of the shaft 18.

Figure 2:
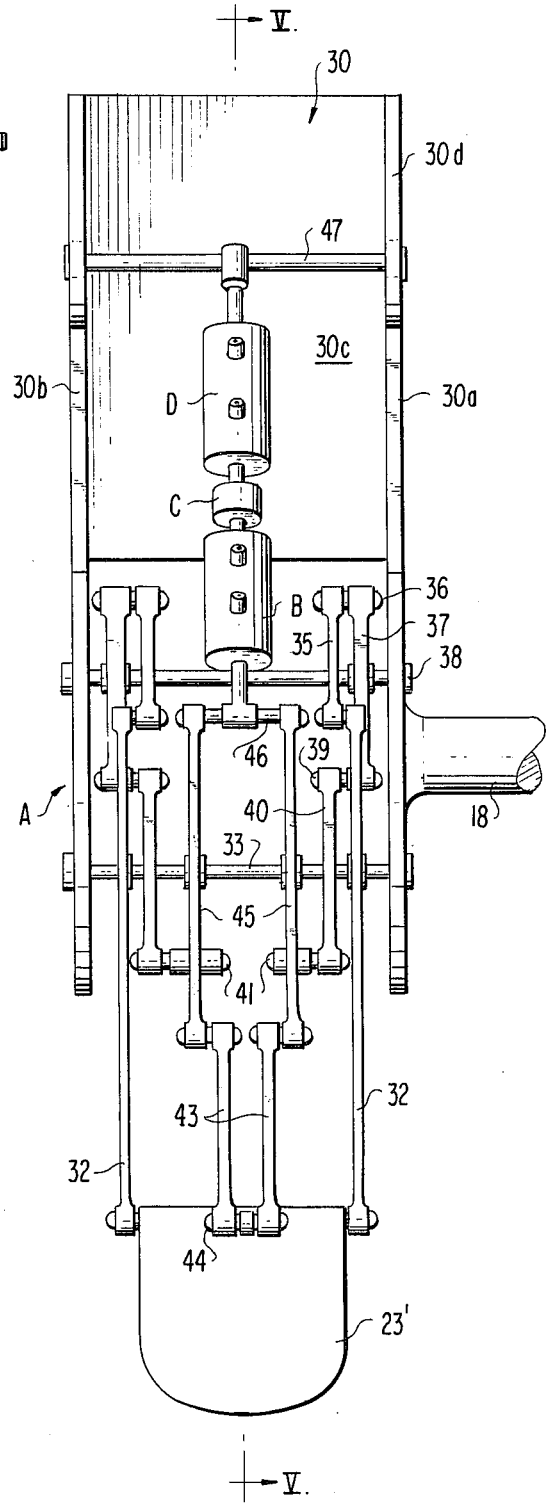
FIG. 2 is an enlarged front view of the present ladle handling apparatus.
Figure 3:
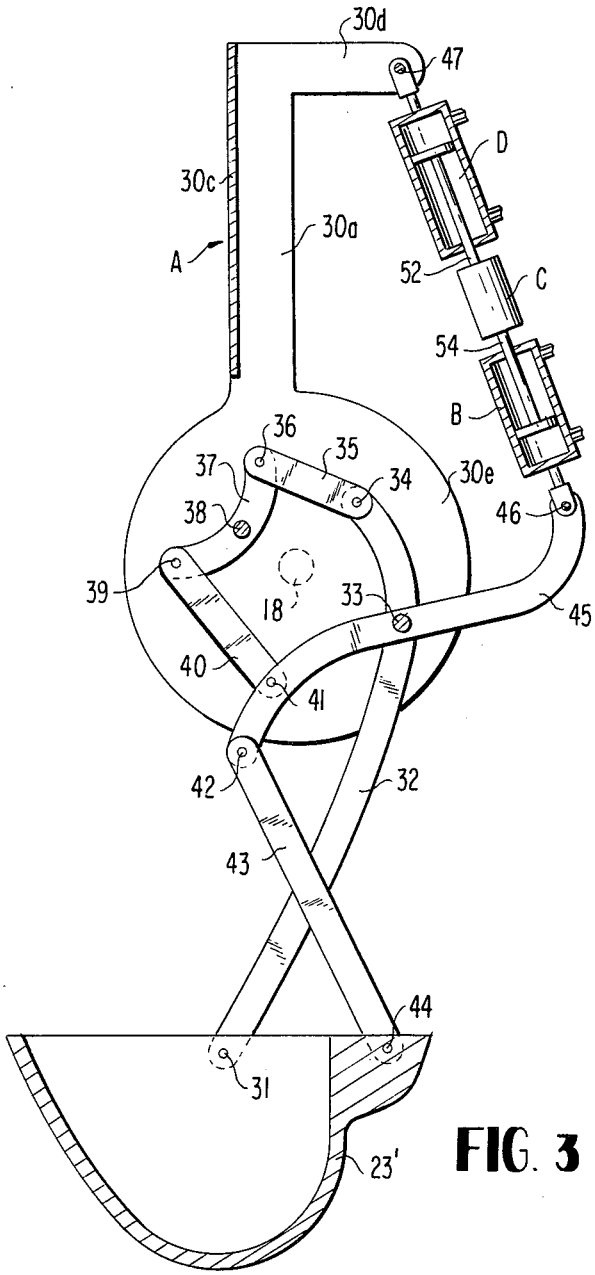
FIG. 3 is a partially cross-sectional side view taken along a line V—V in FIG. 2.

FIG. 2 shows a front view of the ladle operating means A in FIG. 1 in more detail and FIG. 3 is a cross sectional side view of the ladle operating means A taken along a line V—V in FIG. 2.

A support member 30 is fixedly secured suitably to the top end of the horizontal shaft 18. The support member 30 comprises a pair of oppositely disposed support plates 30*a* and 30*b*, each including a securing portion 30*e*, and an arm portion 30*d*. The support plate 30*a* and the securing portion 30*e* are held in parallel by a wall portion 30*c*. Since the mechanical structure is symmetrical for the supporting plates 30*a* and 30*b*, only the structure for one supporting plate will be described. The ladle 23' is supported by a pair of links 32 and 43 connected rotatably to the ladle 23' by pins 31 and 44 respectively as shown. The end portion of the link 32 is rotatably connected to a link 45 by a pin 33 secured to the mounting portion 30*e*. One end of the link arm 45 is rotatably connected to the free end of the link 43 by a pin 42 and the other end of the link 45 is rotatably connected to a driving mechanism to be described.

The link arm 32 is supported rotatably by the pin 33 implanted on the securing portion 30*e* and the free end of the link arm 32 is rotatably connected to one arm of a lever 37 by a pin and arm connection 34, 35 and 36 as shown. The lever 37 is pivotably supported by a fixed pin 38 extending from the securing portion 30*e* and other arm of the lever 37 is connected rotatably to the link 45 by a pin 41 located between the pin 42 and the fixed pin 33.

Figure 4:
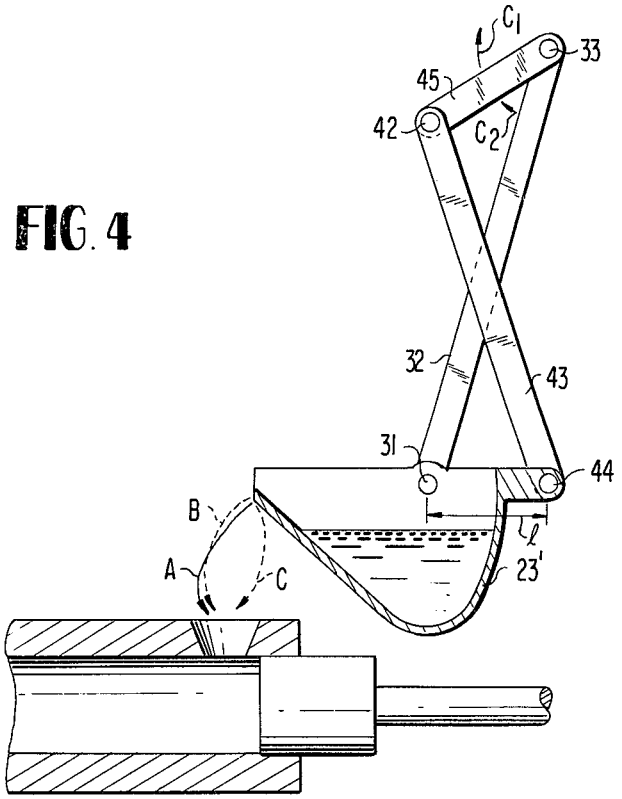
FIGS. 4 and 5 are explanatory illustration of the present ladle handling apparatus.

Describing the operation of the links 32, 43 and 45 with reference to FIG. 4, it is assumed that when the link 45 is uniformly driven in a direction of an arrow $C_1$, the link 32 is rotated uniformly in direction $C_2$ with a certain velocity ratio. The lengths of the links 32, 43 and 45 and the angular positions therebetween are suitably selected so that the pouring end of the ladle 23' travels along a desired locus.

When the lengths of the links 32, 43 and 45 are selected as shown and the velocities of the links 32 and 45, $V_1$ and $V_2$, respectively are made as, for example, $V_1$: $V_2$=3:1, the locus of the pouring end of the ladle 23' will becomes as that shown by the arrow A in FIG. 4. In this manner the locus of the pouring end can be determined such that the end moves within the range of the opening of the cylinder.

The velocity ratio of the link 32 to the link 45 may be determined variously. As one example, it may be obtained by the link mechanism shown in FIG. 3. In FIG. 3, the arm connection 35 one end of which is connected rotatably to an extension of the link 32 by a pin 34, is connected rotatably to the one arm of the lever 37 the other arm of which is conected rotatably to the link 45 through link 40. When the link 45 is rotated by a suitable driving means in the direction shown by the arrow $C_1$, the lever 37 is pivoted clockwisely through the link 40 and, therefore, the link 32 is rotated clockwisely around the pin 33. By selecting the position of the pin 41, the lengths of the arms of the lever 37 and the length of the extension of the link 32 suitably, a desired velocity ratio is easily achievable.

In FIG. 3, the rotation of the link 45 is provided by a fluid pressure driving means which comprises a cylinder D, upper end of which is pivotably supported by a pin 47 fixedly secured to the arm portion 30*d*, a cylinder B, lower end of which is pivotably engaged with the link 45 by the pin 46, piston rods 52 and 54 thereof, and the joint stopper C including a screw joint mechanism and being located in intermediate place between the rods 52 and 54. Therefore, the link 45 can be moved about the pin 33 by suitably driving the two cylinders D and B.

Figure 6:
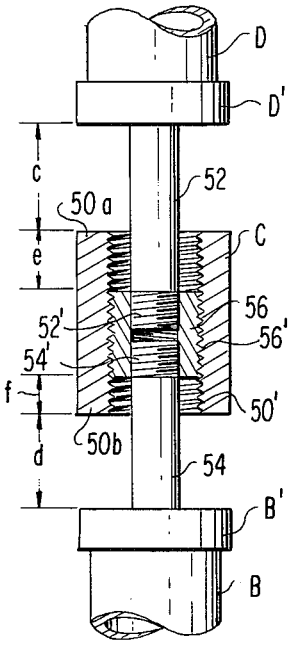
FIG. 6 is an enlarged and partially cross-sectional front view of a portion of the driving mechanism of FIG. 2.

In FIG. 6 which shows the joint stopper C, threadings 52' and 54' are provided at the lower portion of the piston rod 52 of the cylinder D and the piston rod 54 of the cylinder B, respectively, both of which are fixed in the rod coupling member 56. The outer surface of the rod coupling member 56 is formed with thread 56' so as to threadingly engage with an inner thread 56' of the joint stopper C. The fine adjustment of the distance *e* and *f* can easily be made, since the joint stopper C can be finely moved with respect to the rod coupling member 56.

Therefore the adjustment of the distance *c* between the upper end surface 50*a* of the joint stopper C and the end surface D' of the cylinder D and the distance *d* between the lower end surface 50*b* of the joint stopper C and the end surface B' of the cylinder B is changeable in accordance with the distance adjustment of *e* and *f*. In other words $c + e = f + d$. A sum of *c* and *d* is a stroke *s* of the cylinders D and B. The stroke of the cylinder D is equal to that of the cylinder B, and the maximum stroke (Smax) of the either cylinder is equal to and/or larger than the maximum of a $c(c_{max}$, i.e., $d = 0)$ or is equal to and/or larger than the maximum of $d(d_{max}$, i.e., $c = 0)$. In a case where Smax is longer than *c* or *d*, when the piston rods 52 and 54 are retracted into the cylinder D and B, respectively, the upper end surface 50*a* of the joint stopper C contacts with the end surface D' of cylinder D and the lower end surface 50*b* of the joint stopper C contacts with the end surface B' of the cylinder B. Therefore the retraction movements of the pistons are stopped remaining the stroke (Smax − *c*) or (Smax − *d*).

Figure 5:
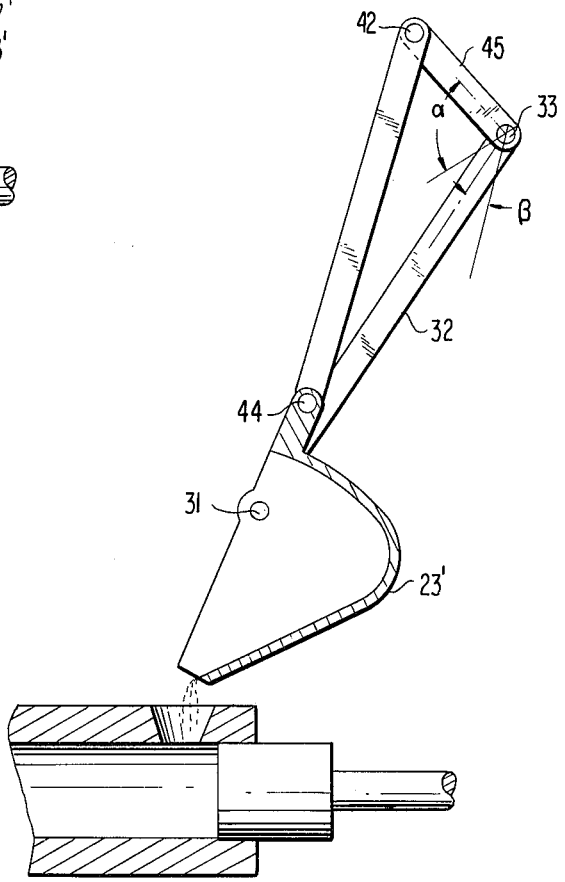
Figure 7A:
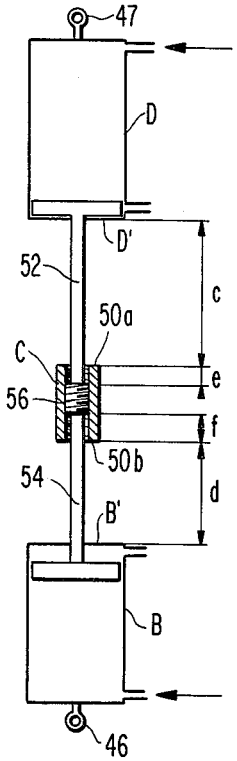
FIGS. 7 a-c illustrates the operation of the driving mechanism in FIG. 2, and FIGS. 8 to 10 are graphs showing velocity relations suitable to obtain desired locusses of the pouring end of the ladle.

FIG. 7 shows the operational relation of the cylinders B and D to the joint stopper. In FIG. 7*a*, when a pressure is supplied to the upper port of the cylinder D and to the lower port of the cylinder B, the piston rod 52 is lowered and the piston rod 54 is lifted. Therefore, the distance between the pins 46 and 47 becomes maximum. The ladle 23' under this condition is shown in FIG. 5. In this state, the links 32 and 45 are in the fully operated state and, assuming the relative position of the ladle 23', links 45 and 32 in FIG. 4 as a reference, the links 32 and 45 are rotated clockwisely about the pin 33 by the angles $\beta$ and $\alpha$, respectively, so that the ladle 23' is tilted by a sufficient angle to pour the content thereof into the opening of the cylinder. The tilting angle of the ladle given under the above condition is referred to, hereinafter, as the "pouring angle".

Figure 7B:
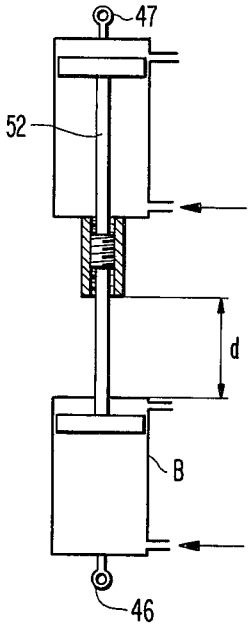

In FIG. 7*b*, the pressure supply to the lower port of the cylinder B is continued and that to the cylinder D is switched by a suitable means (not shown) such as an electromagnetic switch valve to the lower port thereof. Therefore, the piston rod 52 is lifted while the piston rod 54 is held as it is. Accordingly, the end face D' of the cylinder D comes into contact with the upper end face 50*a* of the joint stopper *c* and, therefore, the distance between the pins 46 and 47 becomes shorter than the maximum length in FIG. 7*a* by C.

The ladle state under the above condition is not shown. It should be noted, however, that the state of the ladle 23' under the above condition becomes intermediate between the state in FIG. 5 and a state in FIG. 4, the latter corresponding to FIG. 7*c*, to be described. That is, in the intermediate state, the links 45 and 32 are rotated counterclockwisely by an angle of $\alpha \cdot C/(C+d)$ and an angle of $\beta \cdot C/(C+d)$, respectively.

The tilting angle of the ladle 23' under the above condition is given when the ladle 23' begins to start its upward movement after the receiving of the content therein and, therefore, the tilting angle under the above condition can be used as a measure of the amount of the content to be received by the ladle. The tilting angle under the above condition is referred to hereinafter as the "measuring angle" for determining the amount of molten metal to be received in and hence to be poured by the ladle. The shifting of the ladle 23' from the pouring angle to the measuring angle may also be performed by supplying pressure to the upper ports of the cylinders B and D in the reverse manner from that in FIG. 7*a* to that in FIG. 7*b*, i.e., by switching the pressure supply to the cylinder B from the lower port to the upper port thereof to cause the distance between the pins 47 and 46 to be shortened from the maximum distance in FIG. 7*a* by distance *d*.

In this case, the ladle 23' occupies another intermediate position between the positions shown in FIGS. 4 and 5, respectively, because the links 45 and 32 are rotated counterclockwise about the pin 33 by angles $\alpha \cdot d/(c+d)$ and $\beta \cdot d/(c+d)$, respectively.

Figure 7C:
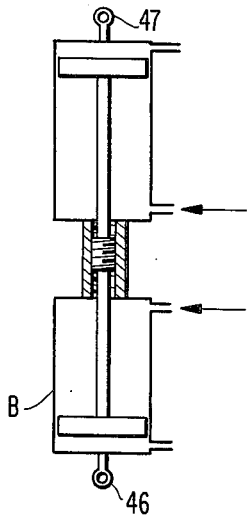

Further, when the pressure is supplied to the lower port of the cylinder D and the upper port of the cylinder B as shown in FIG. 7*c*, the end of face D' of the cylinder D and the end face B' of the cylinder B are in contact with the upper end face 50*a* and the lower end 50*b* of the joint stopper C, respectively, causing $c = 0$ and $d = 0$, resulting in the shortest distance between the pins 46 and 47.

The ladle 23′ under this condition is referred to as having "transportation angle" and is shown in FIG. 4, in which the links 45 and 32 are rotated counterclockwise about the pin 33 by $\alpha$ and $\beta$ to make the latter angles zero, respectively. The attitude of the ladle 23′ in FIG. 4 is maintained during the transportation of the molten metal.

By appropriately selecting the ports of the cylinders to which the pressure is supplied, the ladle 23′ can take any of the pouring state, the intermediate, measuring state and the transportation state. It may also be shifted from the pouring state in FIG. 5 through the intermediate, measuring state (not shown) to the transportation state in FIG. 4.

In summary, the present device can perform each of the following as well as any combinations thereof:

1. pouring → measuring ($c=0$) → transportation
2. pouring → measuring ($d=0$) → transportation
3. pouring → transportation There will be described a simple example of the combinations, with the measuring angle of the ladle 23′ being determined by making $c$ (or $d$) zero as shown in FIG. 10*b* during the molten metal taking operation. When the ladle 23′ is lifted from the molten bath, an excess portion of the molten metal in the ladle will overflow beyond the pouring end thereof. Therefore, it is clear that the measuring angle of the ladle 23′ determines the amount of the molten metal to be taken in by the ladle 23′. After completion of the overflowing, the distance $d$ (or $c$) is made zero to make the attitude of the ladle 23′ horizontal to be ready for the transportation (FIG. 7*c*). The ladle is transported by the present pouring apparatus with the transportation angle at a position just above that at which the cylinder of the die-casting machine is opened. At that position, the distances $c$ and $d$ make $c > 0$ and $d > 0$, respectively, to make the attitude, i.e., the angle of the ladle, the pouring angle (FIG. 7*a*), to cause the predetermined amount of the molten metal in the ladle 23′ to be poured into the cylinder opening. After the completion of the pouring, the ladle 23′ is tilted by the measuring angle (FIG. 7*b*) by actuating the cylinder B or D to cause the distance $c$ or $d$ to be zero, and then the ladle 23′ is transported by the apparatus 1 from the position just above the pouring opening of the cylinder to the position above the molten metal bath and then lowered. It is also possible to maintain the attitude by suitably switching the pressure supply to the cylinders B and/or D to lower the ladle 23′ toward the molten metal bath with the pouring attitude thereof maintained. In such a case, the ladle may be smoothly dipped in the molten metal without upsetting the latter.

Since the rod connecting member 56 and the stopper C are constructed as shown in FIG. 6, the fine regulations of the distance $e$ and $f$ may be easily performed and, therefore, it is easy to make the distances $c$ and $d$ to be $c > d$, $c = d$ or $c < d$. Hence the rotation angles of the links 45 and 32 can be finely regulated, so that the measuring angle of the ladle 23′, i.e., the volume of the molten metal to be received in the ladle, can be easily and finely determined. That is, the amount of molten metal to be poured is controlled by the tilting angle of the ladle when dipped in the molten metal bath.

For example, when the joint stopper C is regulated so that the ratio of the distance $c$ to the distance $d$ becomes 3:2, and the cylinder D is operated from the state in FIG. 7*a* (pouring angle) to that in FIG. 7*b* (measuring angle), i.e., the distance $c$ is made zero, the links 45 and 32 are rotated counterclockwise about the pin 33 by $3\alpha/5$ and $3\beta/5$, respectively, from the positions shown in FIG. 5 and hence the ladle 23′ is rotated clockwise from the pouring angle by an angle of 3/5 times the angle between the pouring angle and the transportation angle. On the other hand, when the cylinder B is operated from the states in FIG. 7*b* (measuring angle) to that in FIG. 7*c* (transportation angle), i.e., the distance $d$ is made zero, the links 45 and 32 are rotated counterclockwise about the pin 33 by $2\alpha/5$ and $2\beta/5$, to make $\alpha = \beta = 0$, respectively, and hence the ladle 23′ is rotated clockwise from the pouring angle in FIG. 8 (FIG. 7*a*) to the transportation angle in FIG. 4 (FIG. 7*c*).

When the distance $c$ is equal to the distance $d$, the ladle 23′ will be rotated clockwise from the pouring angle to the transportation angle.

The link mechanism including the lever 37, the arm connection 35 and the link 40 was described previously to obtain a desired rotational speed ratio between the links 32 and 45.

Alternatively, the velocity ratio can be obtained by a suitable gear arrangement which may be driven by an electric motor or pneumatic device. For example, a pair of gear wheels having a suitable gear ratio (e.g. 3:1) are mounted on the pin 33 such that they can rotate around the pin 33 independently and together with the link 45 and the link 32, respectively. By driving the gear wheels suitably, the links 32 and 45 are rotated at velocities in inverse proportion to the gear ratio.

The link mechanism and the gear driving are mere examples of the means for driving the links 32 and 45 with a suitable velocity ratio and other mechanism such as cam machanism may be utilized for this purpose, or the links may be driven independently separate driving mechanism.

Figure 8:
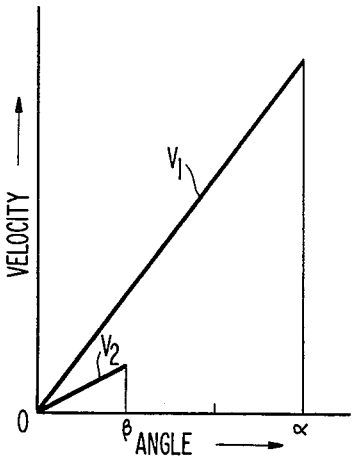
Figure 9:
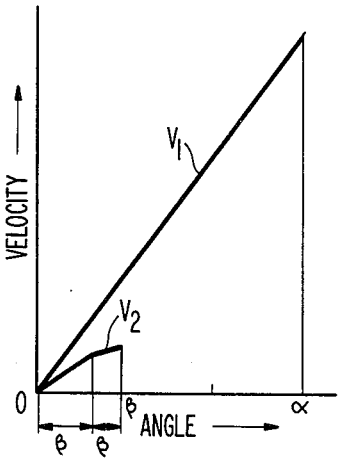
Figure 10:
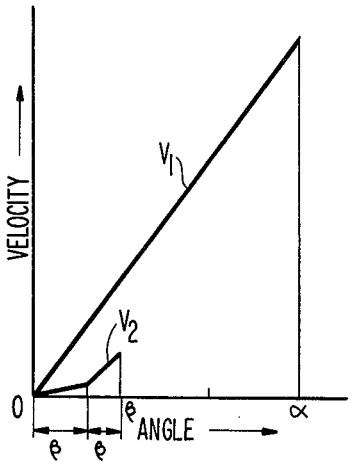

FIGS. 8 to 10 show velocities $V_1$ and $V_2$ of the links 45 and 32 with respect to the rotation angles $\alpha$ and $\beta$ of the links 45 and 32. It is assumed that the rotation angles of the links 45 and 32 in FIG. 4 are 0 and the angles, when the pouring from the ladle 23′ is terminated, as shown in FIG. 5, are $\alpha$ and $\beta$, respectively.

FIG. 8 shows the angles when the link 45 is rotated at a constant velocity $V_1$ and the link 32 is rotated in synchronism with the link 45 at the constant velocity $V_2$ with a constant velocity ratio, $V_1 : V_2 = 3 : 1$. In this case the locus of the pouring end of the ladle 23′ is one indicated by A in FIG. 4.

The locus shown by B in FIG. 4 is obtainable when the link 32 is firstly driven at a constant velocity for an angle between 0 and $\beta_1$, and then driven at another constant velocity lower than the first velocity for an angle between $B_1$ and $B_2$ as shown in FIG. 9.

When the link 32 is firstly driven at a certain velocity and then driven at a higher velocity than the first velocity as shown in FIG. 10, a locus of the pouring end such as shown by C in FIG. 4 is obtainable. In selecting the locus, the angles $\alpha$ and $\beta$ are firstly determined so that the molten material in the ladle is completely poured. Of course, the relation therebetween is $\alpha > \beta$. In addition, the velocity $V_1$ of the link 45 is secondly determined. Thereafter, angles $\beta_1$ and hence $\beta_2$ of the link 32 are determined.

Although the embodiment described utilizes a fixed velocity ratio for full angle range, it is possible to change the velocity ratio as mentioned above. This is convenient to set the locus of the pouring end of the ladle in a desired manner. Further, although the one step shift of the velocity ratio is described, the number of the steps is arbitrary. The larger the number of the steps may provide, the finer the locus regulation. In order to employ the variable velocity ratio system, it is necessary to use a variable velocity gear mechanism which will be known in the art. In any way, the employment of the variable velocity system and the number of the steps should be determined according to the volume of molten material to be poured, the size of the ladle, the size of the opening into which the molten material is to be poured and the size of product to be die-casted.

According to the present invention, the pouring end of the ladle is substantially stationarily maintained with respect to the opening into which the content of the ladle is to be poured. Further, by employing the combination of the cylinders and the joint stopper as the driving means for driving the link structure, the tilting of the ladle can be finely regulated. These advantages are significant in this field.

What is claimed is:

1. A ladle operating apparatus of an automatic molten metal feeding apparatus for use in a die-casting machine comprising: a movable first link arm means rotatably supported by a first stationary shaft pin and having one end rotatably connected to a suitable point on the ladle, a movable second link arm means having one end rotatably connected to another point on the ladle and having another end, a movable third link arm means having one end rotatably connected to said first stationary shaft pin and having another end, a pivot pin, said other ends of said second and third link arm means being rotatably connected to said pivot pin, and means for synchronously rotating said first and said third link arm means around said first stationary shaft pin with a suitable velocity ratio.

2. A ladle operating apparatus set forth in claim 1, wherein said synchronously rotating means comprises a link mechanism including a pivot lever means pivotably supported by a second stationary shaft pin and having one end rotatably connected to the other end of said first link arm means and the other end rotatably connected to said third link arm means.

3. A ladle operating apparatus set forth in claim 2, wherein said one end of said third link arm means is extended and said means for rotating comprises a pressure cylinder means rotatably connected to the extension of said third link arm means.

4. A ladle operating apparatus set forth in claim 3, wherein said pressure cylinder means comprises a pair of cylinders each having a piston rod, one of said cylinders being rotatably connected to said extension of said third link arm means and the other cylinder being rotatably supported by a third stationary shaft pin, a rod coupling member for mutually connecting said piston rods, means slidable on said rod coupling member to regulate the strokes of said piston rods and means for selectively driving said cylinders.

5. A ladle operating apparatus set forth in claim 2, wherein said link mechanism further comprises:

a fourth link arm means pivotably connected at one end thereof to said one end of said pivot lever means and at the other end thereof to said first link arm means; and a fifth link arm means pivotably connected at one end thereof to said other end of said pivot lever means and at the other end thereof to said third link arm means.

* * * * *